United States Patent [19]

Scholl

[11] 4,412,498

[45] Nov. 1, 1983

[54] CONTROL DEVICE FOR A DIFFERENTIAL FEED OF A SEWING MACHINE

[75] Inventor: Hans Scholl, Oerlinghausen-Lipperreihe, Fed. Rep. of Germany

[73] Assignee: Kochs Adler AG, Bielefeld, Fed. Rep. of Germany

[21] Appl. No.: 370,797

[22] Filed: Apr. 22, 1982

[30] Foreign Application Priority Data

May 13, 1981 [DE] Fed. Rep. of Germany ..... 3118964

[51] Int. Cl.[3] ..... D05B 27/08

[52] U.S. Cl. ..... 112/313; 112/121.11

[58] Field of Search ..... 112/313, 312, 121.11, 112/121.12

[56] References Cited

U.S. PATENT DOCUMENTS 3,855,956 12/1974 Wurst ..... 112/158 E
3,980,032 9/1976 Kleinschmidt et al. ..... 112/313
4,143,607 3/1979 Hager ..... 112/313
4,274,345 6/1981 Schneider et al. ..... 112/312 X
4,303,027 12/1981 Uemura et al. ..... 112/313 X

*Primary Examiner*—H. Hampton Hunter
*Attorney, Agent, or Firm*—Max Fogiel

[57] ABSTRACT

A control device for a differential feed system of a sewing machine in which a control box is connected to a control motor regulating the relation of the feed rates imparted to feed elements engaging a workpiece. The control motor is formed as a pneumatic cylinder composed of individual single acting cylinders arranged in a carrier tube is series, and is operably connected to the differential feed system including two independently adjustable feed mechanisms each regulated by such a pneumatic cylinder. Different feeding conditions for the workpiece, such as feeding the workpiece in a compressed, stretched or neutral relation at various stitch lengths, may be selected by the operator at the control box.

6 Claims, 7 Drawing Figures

| No. | D | C | B | A | H (mm) |
|---|---|---|---|---|---|
| 1 | 0 | 0 | 0 | 0 | 0 |
| 2 | 0 | 0 | 0 | 1 | 1,25 |
| 3 | 0 | 0 | 1 | 0 | 2,50 |
| 4 | 0 | 0 | 1 | 1 | 3,75 |
| 5 | 0 | 1 | 0 | 0 | 5,00 |
| 6 | 0 | 1 | 0 | 1 | 6,25 |
| 7 | 0 | 1 | 1 | 0 | 7,50 |
| 8 | 0 | 1 | 1 | 1 | 8,75 |
| 9 | 1 | 0 | 0 | 0 | 10,00 |
| 10 | 1 | 0 | 0 | 1 | 11,25 |
| 11 | 1 | 0 | 1 | 0 | 12,50 |
| 12 | 1 | 0 | 1 | 1 | 13,75 |
| 13 | 1 | 1 | 0 | 0 | 15,00 |
| 14 | 1 | 1 | 0 | 1 | 16,25 |
| 15 | 1 | 1 | 1 | 0 | 17,50 |
| 16 | 1 | 1 | 1 | 1 | 18,75 |

CONTROL DEVICE FOR A DIFFERENTIAL FEED OF A SEWING MACHINE

BACKGROUND OF THE INVENTION

The present invention relates to a control device of a sewing machine feeding system, which is installed with independently controllable feeding elements so as to sew a workpiece in a stretched, neutral or compressed condition.

On an international exhibition for shoe production (IMS 1979, Pirmasens/Germany) a sewing machine installed with a differential feeding system with a control device was presented, which may be applied for performing ruffling sewing operations at which the ruffled fullness or surplus of material was fixed by a seam or by a fixing tape. In order to simplify this operation, the sewing machine was installed with a control device, in which various rates of fullness may be stored and which may be referred to by a number of push buttons. Besides a number of push buttons, the control device was installed with a selector switch that allowed the operator to put in a further value of feeding movement which is not available in the control device such as a neutral feeding rate, i.e. the workpiece will be fed by the feeding elements at equal feed rates. By actuation of an additional switch, the operator is enabled to either select the feed rates set in the control device, or the feed rate put in by the selector switch during the sewing operation.

At the exhibited sewing machine the adjustment of the stitch regulating mechanism cooperating with the feeding elements engaging the workpiece was performed by a cam disc installed on a shaft of a gear motor. By the selection of various feed rates the cam disc was positioned in various angular positions by the gear motor connected to the control box in a closed loop arrangement.

In U.S. Pat. No. 3,855,956 there is shown a mechanism for converting digital information in a control movement of a regulating element. Such a mechanism having jointly connected levers of different lengths selectably displaced by solenoids and generally considered as a digital linear motor, is suited to quickly alter the shifted conditions. However, this mechanism allows only to execute short distances of travel at relatively low forces.

Accordingly, it is a main object of the present invention to provide a simple control motor which does not require a closed loop controlled gear motor.

It is a further object of the present invention to install the differential feed sewing machine with a low-cost adjustment device, which is simple in design and reliable in operation.

Still another object of the present invention is to provide an adjustment device of space saving design and which also allows handling of higher adjustment forces.

SUMMARY OF THE INVENTION

The objects of the present invention are achieved by providing a stitch regulating mechanism with a pneumatic cylinder having various work positions actuated by a control. Due to this construction, it is possible to achieve larger adjustment distances and adjustment forces.

The arrangement of individual cylinders serially arranged and received in a carrier tube, allows a very space-saving and low-cost design. Providing each individual stitch regulating mechanism with an individual multi-position-cylinder extends the range of selectable feed rates. The construction of a multi-position-cylinder composed of different individual cylinders dimensioned with different strokes forming the proportion 1:2:4:8 etc. assures a maximum of selectable adjustment positions at a minimum number of individual cylinders, at which the derived adjustment positions are equally spaced relative to each other with a stroke increment value of the smallest cylinder's stroke.

Other objects, advantages and features of the present invention will appear from the detailed description of the preferred embodiment which will now be explained in conjunction with the accompanying drawings.

DESCRIPTION OF THE PREFERRED EMBODIMENT

Figures 1, 7:
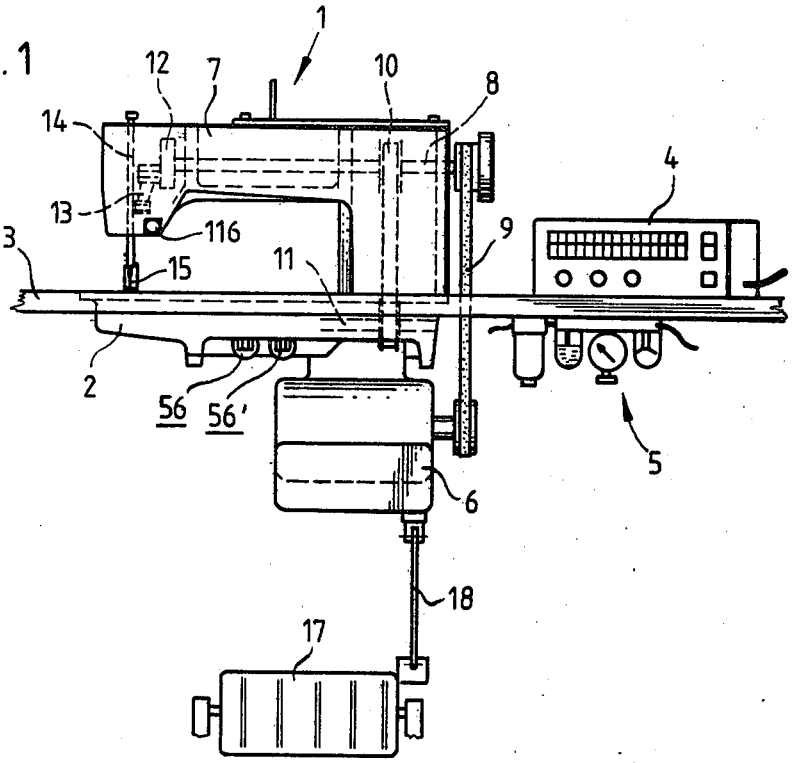
FIG. 1 is a total view of a sewing machine with a control device, according to the present invention.
FIG. 7 is a table listing various shifted conditions of the individual cylinders with each achieved stroke.

A sewing machine 1 with a base plate 2 is received on a workplate 3, having an upper surface on which is arranged a control device 4 and a lower surface on which an air conditioning device 5 and a drive motor 6 (FIG. 1) are mounted. The sewing machine 1 is formed with an arm 7, in which is pivoted an arm shaft 8. The arm shaft 8 is connected via a belt drive 9 and a timing belt 10 within the sewing machine 1 to one end of a shaft 11 supported in the base plate 2. The arm shaft 8 is provided with a crank 12, which is hingedly connected via a link 13 to a needle bar 14 located in the arm 7. To the needle bar 14 there is fastened a needle 15 by means of a screw 16 (FIG. 2). According to FIG. 1, there is connected a pedal 17 to the drive motor 6 by means of a tie rod 18.

The shaft 11 is pivotally received in bearings 19, 20 of the base plate 2 and provided at its free end with two eccentrics 21, 22, which are embraced by forked ends 23, 24 of two feed dog carriers 25, 26. The feed dog carrier 25 is drivingly connected to a stitch regulating mechanism S and the feed dog carrier 26 is drivingly connected to a stitch regulating mechanism S'. The shaft 11 is formed with two further eccentrics 27, 27', to which is pivoted a tie rod 28 or 28'. Into the free ends of the tie rods 28, 28' there is pressed a bolt 29 or 29' projecting on both sides and pivoted in links 30, 30' or 31, 31'. The links 30,30' are hingedly connected to off-drive cranks 33, 33' by bolts 32, 32'. The off-drive crank 33 is secured to a hollow shaft 34, which is pivoted in bearings 35, 36 of the base plate 2. The hollow shaft 34 is formed with a crank 37, the forked end 38 of which is hingedly connected to the feed dog carrier 25 by means of a bolt 39. The off-drive crank 33' is secured to a rocking shaft 40, which is pivotally received in a bearing 41 of the base plate 2 and the hollow shaft 34. The rocking shaft 40 has a crank 42, the forked end 43 of which is hingedly connected to the feed dog carrier 26 by a bolt 44. The links 31, 31' are hingedly connected to levers 46, 46' of adjustment shafts 47, 47' by bolts 45, 45'. The adjustment shafts 47, 47' are pivotally received in a mutual bearing 48 and in bearings 49, 50 of the base plate 2.

Figure 3:
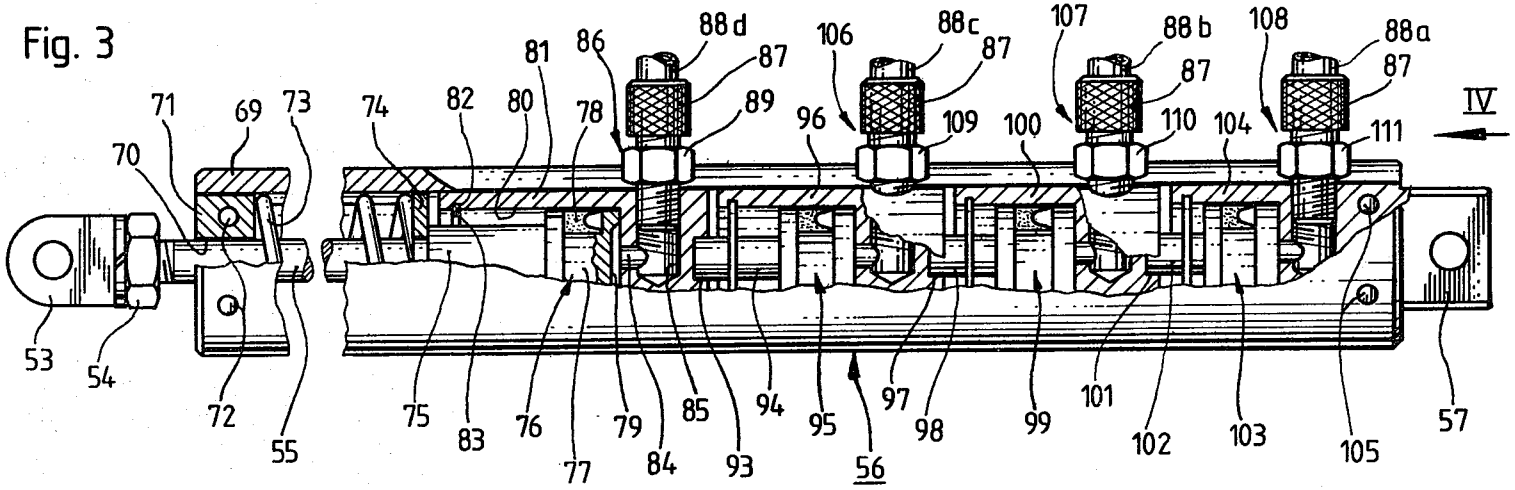
FIG. 3 is a partial sectional view of the pneumatic cylinder, on an enlarged scale.

Secured to each of the adjustment shafts 47, 47' is a crank 51, 51', which is hingedly received in fork 53, 53' by means of bolt 52, 52'. The forks 53, 53' are secured by nuts 54 to piston rods 55, 55' as elements of a first and a second cylinder 56, 56' (FIG. 3). Both cylinders 56, 56' are formed with flattened ends 57, 57', which are received in forked bearings 59, 59' of the base plate 2 by means of bolts 58, 58'. The feed dog carriers 25, 26 are each provided with two threads (not shown), in which a first feed dog 60 or a second feed dog 61 is received by means of screws (not denoted).

Figure 5:
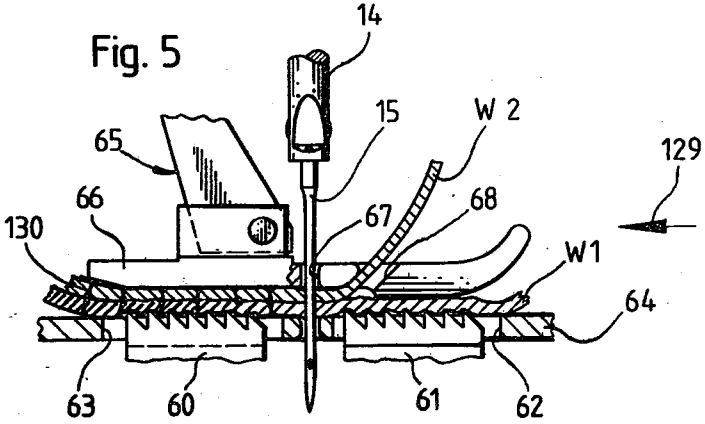
FIG. 5 is an enlarged view of the stitch forming area with the feed dogs arranged at both sides of the needle.

According to FIG. 5, the feed dogs 60, 61 are arranged at both sides of the needle 15 and project through openings 62, 63 of a throat plate 64, which is mounted on the base plate 2. A presser foot 65 pivoted in the arm 7 extends with its hingedly arranged sole 66 over both feed dogs 60, 61. The sole 66 is formed with a recess 67 for the needle 15 and an opening 68 extending in front of the needle 15 with respect to the sewing direction.

Figure 4:
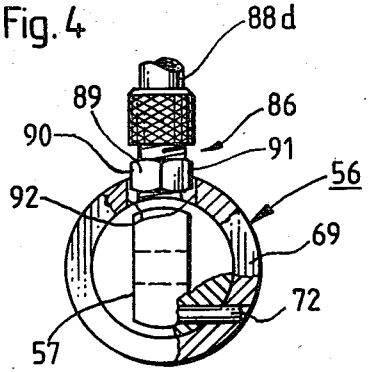
FIG. 4 is a side elevation of the cylinder in the direction of the arrow IV of FIG. 3.

The construction of the first cylinder 56, which corresponds to the second cylinder 56', is hereinafter described in connection with FIGS. 3 and 4 as follows:

The housing of the first cylinder 56 is formed by a carrier tube 69, to which piston rod end is fastened and end piece 71 having a bearing 70 by means of two pins 72. The pins 72 extend transversely with respect to the longitudinal axis of the first cylinder 56 and on both sides of the piston rod 55. A spring 73 is suspended at the end piece 71 on one hand and at a disc 74 on the other hand, which is displaceably received in the carrier tube 69. The piston rod 55 is formed with a shoulder 75, on which rests the disc 74. The shoulder 75 terminates in a piston 76 having a groove 77 for a gasket ring 78 and a recess 79. The piston 76 is displaceably received in a bore 80 of a cylindrical part 81, which is displaceably supported in the carrier tube 69. The cylindrical part 81 is provided with a groove 82 for a retaining ring 83 and a bore 84 concentrically arranged with respect to the bore 80. The bore 84 terminates in a radially extending blind hole 85. The blind hole 85 is formed with a thread (not denoted) for receiving a hose fitting 86. To the hose fitting 86 there is fastened a hose **88*d* by means of a knurled nut 87. The hose fitting 86 is provided with a hexagon 89, from which two parallel extending surfaces 90, 91 project into a groove 92 extending in parallel with the longitudinal axis of the cylinder 56. The free end of the cylindrical part 81 is formed with a concentrically arranged bore 93, into which projects a piston rod 94. The piston rod 94 terminates in a piston 95, which is formed like the piston 76 and is displaceably received in a cylindrical part 96. The cylindrical part 96 is formed like the cylindrical part 81, but is constructed with a different stroke. The cylindrical part 96 has a bore 97, into which projects a piston rod 98. The piston rod 98 terminates in a piston 99 like the piston 76 and is displaceably supported in a further cylindrical part 100, which is formed like the cylindrical part 81 with the exception of the stroke. The cylindrical part 100 is provided with a bore 101, into which projects a piston rod 102 terminating in a piston 103 profiled like the piston 76. The piston 103 is displaceably received in a cylindrical part 104 like the cylindrical part 81, but is provided with a different stroke. The cylindrical part 104 forms with the flattened end 57 one part and is, like the end piece 71, secured to the carrier tube 69 by means of pins 105. As well as the cylindrical part 81, the cylindrical parts 96, 100 and 104 are each provided with a hose fitting 106, 107 and 108, the hexagons 109, 110 and 111 of which project through the groove 92 of the carrier tube 69 (FIG. 4). In the following description the pistons/cylindrical parts 103/104; 99/100; 95/96; and 76/81** are denoted as individual cylinders A, B, C, and D.

Figure 2:
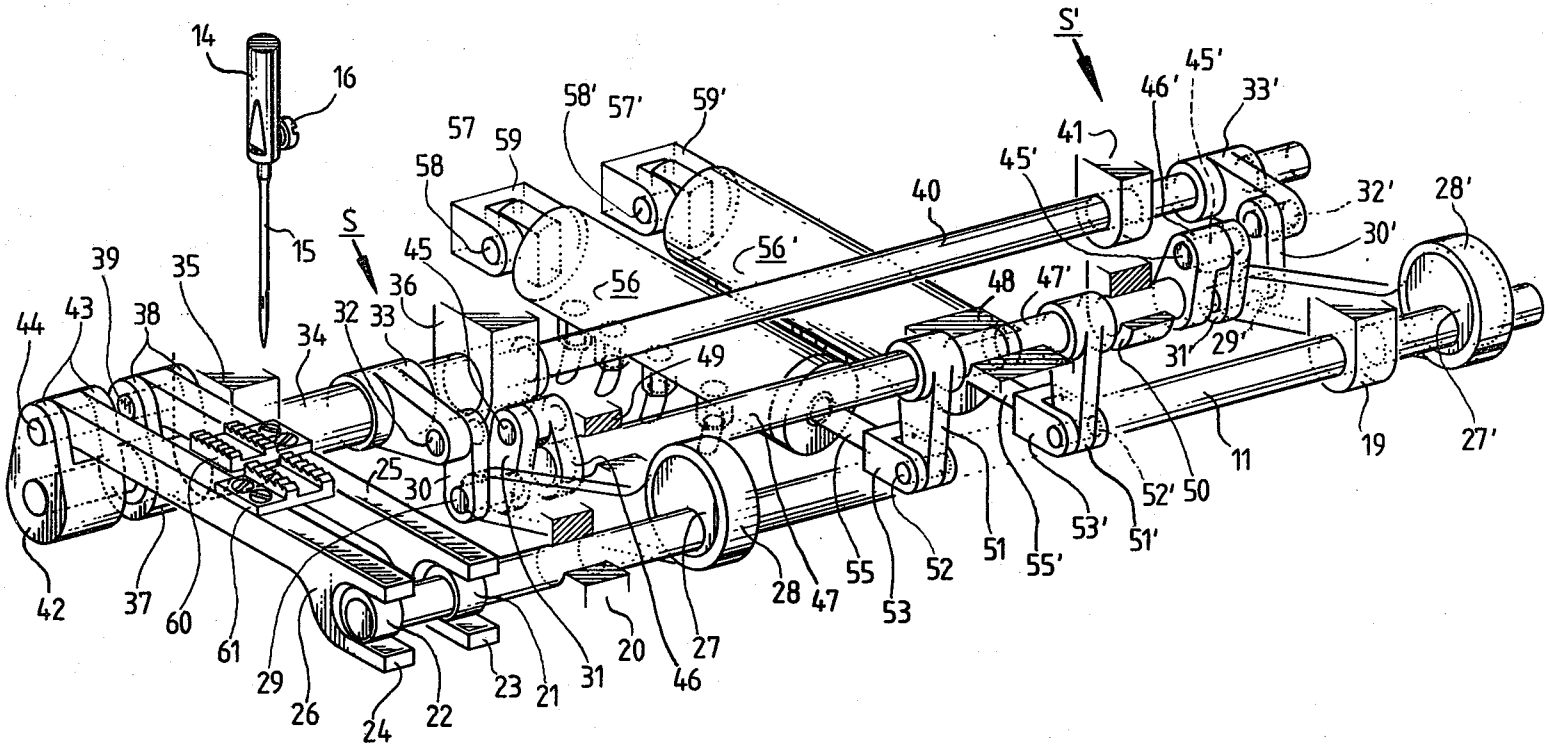
FIG. 2 is a perspective view of the stitch regulating mechanism actuating the feed dogs including the control device according to the present invention.
Figure 6:
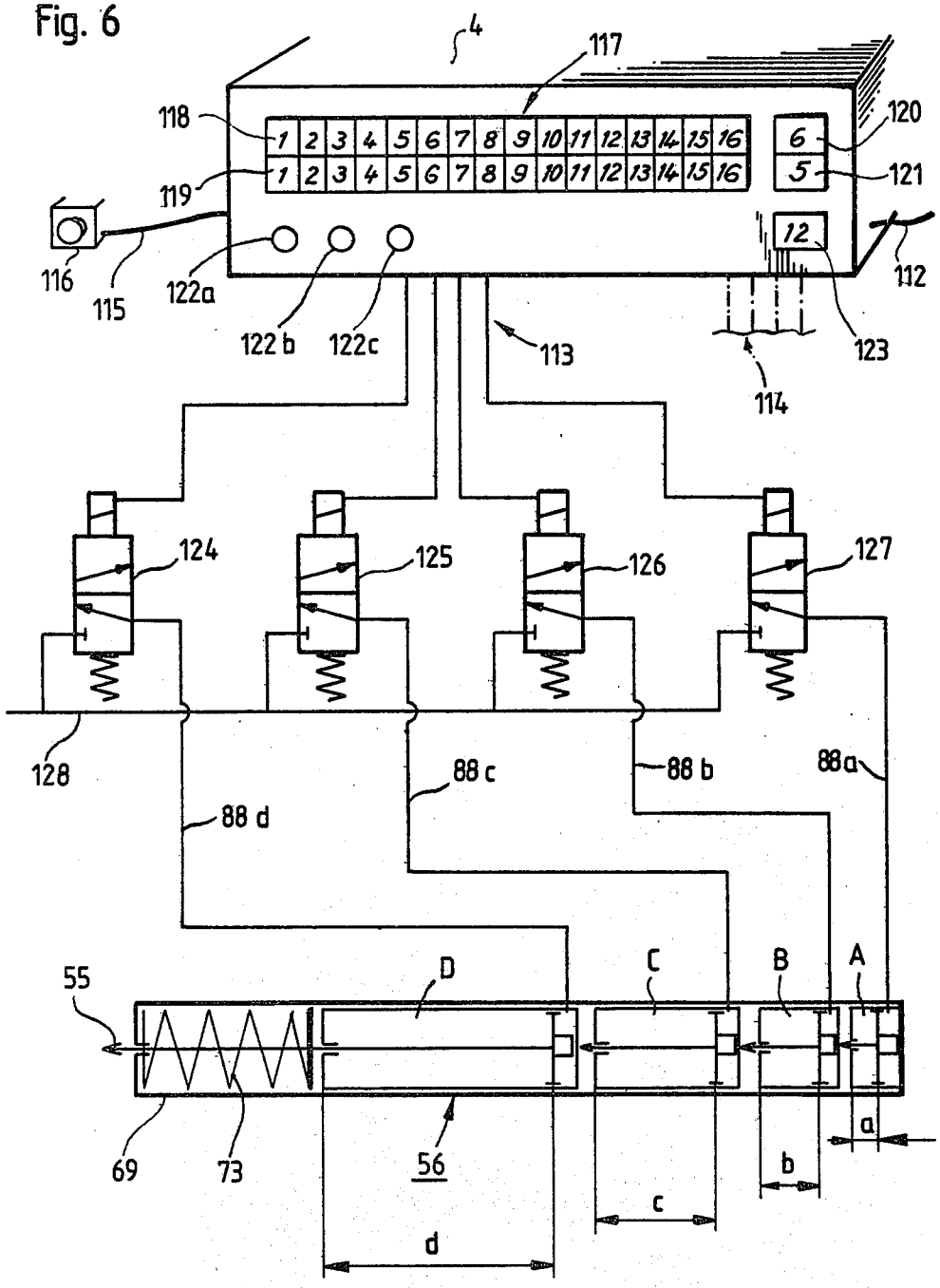
FIG. 6 is a schematic illustration of the control device according to the present invention.

According to FIG. 6, the control device 4 (FIG. 1) is provided with a supply line 112, two output cables 113, 114 and a further cable 115 which is connected to a switch 116 secured to the arm 7 of the sewing machine 1 (FIG. 1). Furthermore, the front surface of the control device 4 is provided with a key board 117 having two differently arranged rows of keys 118, 119. Adjacent to the rows of keys 118, 119 there are provided indicators 120, 121. Below the key board 117 there are various push buttons **122*a*, 122*b*, 122*c* having pilot lights, and a further indicator 123. The control device 4 comprises a not further described programmable control which is connected via the output cables 113, 114 to valves 124, 125, 126 and 127. In FIG. 6 the valves connected with the output cable 114 are omitted. The valves 127, 126, 125 and 124 are connected to a supply line 128 and are each connected by a hose 88*a* or 88*b* or 88*c* or 88*d*** to the individual cylinder A or B or C or D formed with strokes denoted with a, b, c and d.

Operation of the control device 4 may be described as follows:

Due to identical construction of the stitch regulating mechanism, hereinafter the operation of the first stitch regulating mechanism S will be described only.

The shaft 11 driven by the arm shaft 8 via the timing belt 10 turns the eccentrics 21 and 22 and the eccentrics 27 and 27', upon which the eccentric 27 imparts a movement to the stitch regulating mechanism S. The tie rod 28 generates at the hinge 31 via the bolt 29 an oscillatory movement, which extends about the center of the bolt 45. This oscillatory movement may be shifted about the center of the adjustment shaft 47 due to different positions of the lever 46, so that via the link 30 thrust movements are imparted to the off-drive crank 33 which are transmitted to the first feed dog 60 by means of the hollow shaft 34, the crank 37, the bolt 39 and the feed dog carrier 25.

As obvious from FIG. 2, an oscillatory movement is imparted to the second stitch regulating mechanism S' by the eccentric 27' which is finally transmitted as a thrust movement to the second feed dog 61 by means of the shaft 40, the crank 42 and the feed dog carrier 26. Due to the superposition of the thrust movements with the lifting movements induced by the first and second stitch regulating mechanism S and S' via the feed dog carriers 25 and the eccentrics 21, 22, the first and second feed dog 60 and 61 perform a flattened elliptical feeding movement.

As described, the feeding movements of the first and second stitch regulating mechanism S and S' may be altered by an adjustment of the adjustment shafts 47, 47' via the cranks 51, 51' and the first and second cylinder 56 and 56'. The spring 73 (FIG. 3) arranged in the first cylinder 56 causes the piston 76 to abut against the bottom of the cylindrical part 81, which in turn presses the piston 95 into the bottom of the cylindrical part 96, the piston 99 into the bottom of the cylindrical part 100, and the piston 103 into the bottom of the cylindrical part 104 pivotally suspended at the bearing 59 of the base plate 2. The piston rod 55 of the piston 76 is guided in the bearing 70 of the end piece 71 while the piston rods 94, 98 and 102 are each guided in the bores 93, 97 and 101 of the cylindrical parts 81, 96 and 100.

As apparent from the schematic illustration of the cylinder 56 in FIG. 6, the various individual cylinders A, B, C and D are dimensioned with strokes a, b, c and d which form a proportion of 1:2:4:8. According to FIG. 3, the strokes a, b, c and d are each limited by the retaining rings 83 arranged in the cylindrical parts 81, 96, 100 and 104. When pressurizing the pistons 76, 95, 99, 103, the cylindrical parts 81, 96, 100 are correspondingly displaced in the carrier tube 69 against the force of the spring 73, at which the surfaces 90, 91 of the hose fittings 86, 106, 107 in conjunction with the groove 92 of the carrier tube 69, prevent the cylindrical parts 81, 96 and 100 from turning.

In FIG. 7 there is shown a table containing the different shift conditions of the individual cylinders A, B, C and D, which in this embodiment are provided with the strokes a=1.25 mm, b=2.5 mm, c=5 mm and d=10 mm. In the table, for instance, the shift condition of the first cylinder 56 as per No. 8—the individual cylinders A, B and C are actuated as the individual cylinder D is not actuated—leads to a stroke at the piston rod 55 of H=8.75 mm.

According to FIG. 5, the second feed dog 61 engages a workpiece ply W1 and advances it by the counterpressure of the sole 66 towards the needle 15, i.e. in sewing direction 129. Behind the needle 15 the feed dog 60 engages the workpiece ply W1 and a workpiece ply W2 which is connected to the workpiece ply W1 by a seam 130. The stitch length of the produced seam 130 may be pre-selected by the operator with the row of keys 119, the keys 1 to 16 of which represent different feed rates (stitch lengths) of the first feed dog 60, e.g. in a range of 2 to 6 mm. The pre-selected feed rate is visible at the indicator 121, at which the control device 4 actuates the corresponding valves. The corresponding action of the first cylinder 56 causes the first stitch regulating mechanism S to produce the desired feed rate at the first feed dog 60. The feed rate of the second feed dog 61 may be pre-selected in the same manner by the keys 1 to 16 of the row of keys 118, at which the selected key is visible at the indicator 120.

Due to the different feed rates of the first and second feed dog 60 and 61, the workpiece ply W1 may be sewn alone, or together with the workpiece ply W2, e.g. a ribbon, a binding etc. in a ruffled, stretched or neutral condition.

By means of the push buttons 122*a*, 122*b* and 122*c* provided at the control device 4, it is possible to insert a program to recall or reset it to its programmed initial point, at which the program may contain the prescribed sewing operations. By operating the pedal 17, the sewing machine 1 is driven by the drive motor 6. In the mode "recall program" the operator may stop the sewing machine 1 after the reaching markings provided at the workpiece ply W1, in order to recall by pushing the switch 116 the following program portion which is indicated at the indicator 123.

The described embodiment of the control device according to the present invention may also be used in conjunction with a differential feed sewing machine having in addition to the second feed dog 61 an upper feed dog. The latter cooperates with the second feed dog 61 in front of the needle 15 with respect to the sewing direction 129. Moreover, a differential feeding sewing machine may be carried out with a first feed dog 60 arranged behind the needle 15 with respect to the sewing direction 129 and determining the stitch length by means of a stitch regulating mechanism which is provided with a manually adjustable regulator.

What is claimed is:

1. A control device for a sewing machine with stitch forming means including a needle and differential feed means for advancing a workpiece having at least one ply in a sewing direction comprising:
   - first feed means arranged behind said needle with respect
   - a first feed unit imparting a feed rate to said first feed means;
   - second feed means arranged in front of said needle with respect to said sewing direction; and
   - a second feed unit imparting a feed rate to said second feed means;
   - said control device including:
   - a control box;
   - a control device controlled by said control box for regulating the relation of said feed rates imparted to said first and said second feed means comprising: solenoid valves operated by said control box and
     - a pneumatic cylinder having individual cylinders arranged in series and operated by said solenoid valves.

2. A control device as claimed in claim 1, wherein said pneumatic cylinder comprises:
   - a piston rod and
   - a carrier tube receiving said individual cylinders, and whereat an individual cylinder oppositely arranged to said piston rod is firmly connected to said carrier tube.

3. A control device as claimed in claim 1, wherein said individual cylinders are dimensioned with individual strokes forming a proportion of 1:2:4:8.

4. A control device for a sewing machine with stitch forming means including a needle and differential feed means advancing a workpiece having at least one ply in a sewing direction, comprising:
   - first feed means arranged behind said needle with respect to said sewing direction;
   - a first feed unit imparting a feed rate to said first feed means;
   - first regulating means for altering said feed rate of said first feed means;
   - second feed means arranged in front of said needle with respect to said sewing direction;
   - a second feed unit imparting a feed rate to said second feed means, and
   - second regulating means for altering said feed rate of said second feed means;

said control device including:
   - a control box; and
   - a control drive controlled by said control box for regulating the relation of said feed rates imparted to said first and second feed means comprising:
     - a first pneumatic cylinder operably connected to said first regulating means;

a second pneumatic cylinder operably connected to said second regulating means and a first and a second group of solenoid valves controlled by said control box, each of said cylinders including individual cylinders operated by one of said group of solenoid valves.

5. A control device for a sewing machine as claimed in claim 4, wherein said individual cylinders are received in a carrier tube in a serial arrangement, said individual cylinders being formed with individual strokes dimensioned in a proportion of 1:2:4:8.

6. A control device for a sewing machine having a housing including a base plate;

stitch forming means with a needle and differential feed means advancing a single- or multiply workpiece in a sewing direction, comprising:

first feed means arranged behind said needle with respect to said sewing direction;

a first feed unit installed in said base plate and imparting a feed rate to said first feed means;

first regulating means for altering said feed rate of said first feed means;

second feed means arranged in front of said needle with respect to said sewing direction;

a second feed unit imparting a feed rate to said second feed means; and second regulating means for altering said feed rate of said second feed means, said control device including:

a control box;

a control drive controlled by said control box for regulating the relation of said feed rates imparted to said first and second feed means, and comprising:

a first and a second group of solenoid valves operated by said control box for controlling a compressed air flow;

a first pneumatic cylinder arranged in said base plate and having individual cylinders operated by said first group of solenoid valves and operably connected to said first regulating means and a second pneumatic cylinder arranged in said base plate and having individual cylinders operated by said second group of solenoid valves and operably connected to said second regulating means, said first and said second cylinder being composed of equal elements including serially arranged individual cylinders received in a carrier tube and having different strokes forming a proportion of 1:2:4:8.

* * * * *